US005611364A

United States Patent [19]

Woods et al.

[11] Patent Number: 5,611,364

[45] Date of Patent: Mar. 18, 1997

[54] PORTABLE SHADE UMBRELLA

[76] Inventors: John G. Woods; Maribeth Woods, both of 3933 Benton Blvd., Kansas City, Mo. 64130

[21] Appl. No.: 520,490

[22] Filed: Aug. 29, 1995

[51] Int. Cl.[6] ..... A45B 11/00

[52] U.S. Cl. ..... 135/21; 135/31; 135/32; 135/33.2; 135/33.5; 135/23; 135/44; 135/90

[58] Field of Search ..... 135/15.1, 21, 20.1, 135/88.03, 88.04, 90, 98, 117, 23, 31, 32, 33.2, 33.5, 27, 44, 96, 151, 158; 362/351, 356, 359

[56] References Cited

U.S. PATENT DOCUMENTS

| | | | |
|---|---|---|---|
| 176,145 | 4/1876 | McRedmond et al. | 325/21 |
| 200,945 | 3/1878 | Smith | 35/21 |
| 1,006,240 | 10/1911 | Lewis | 135/33.5 |
| 1,706,341 | 3/1929 | Xussman | 135/33.2 |
| 1,826,063 | 10/1931 | Frenck | 135/33.2 |
| 2,551,297 | 5/1951 | Sherman | 135/33.5 X |
| 2,764,993 | 10/1956 | Wallace et al. | 135/5 |
| 2,767,723 | 10/1956 | Sears, Jr. | 135/21 |
| 2,871,868 | 2/1959 | Al Faasse et al. | 135/46 |
| 3,120,238 | 2/1964 | Aglatz | 135/21 |
| 3,429,320 | 2/1969 | Edelkind | 135/34 |
| 4,061,154 | 12/1977 | Cox et al. | 135/33.5 X |
| 4,347,862 | 9/1982 | Secon | 135/20 |
| 4,449,542 | 5/1984 | McSwain et al. | 135/21 X |
| 5,002,081 | 3/1991 | Stromeyer | 135/21 |
| 5,068,955 | 12/1991 | Gonet | 135/33.5 X |
| 5,339,847 | 8/1994 | Kanter et al. | 135/16 |
| 5,429,147 | 7/1995 | Barrington | 135/33.5 |

FOREIGN PATENT DOCUMENTS

| | | | |
|---|---|---|---|
| 802857 | 9/1936 | France | 135/20.1 |
| 334821 | 9/1989 | Japan | 135/20.1 |

*Primary Examiner*—Carl D. Friedman
*Assistant Examiner*—Beth A. Aubrey
*Attorney, Agent, or Firm*—Kenneth W. Iles

[57] ABSTRACT

A portable shade umbrella comprises a weighted base having a supporting pole secured in it, with the supporting pole having a curved upper section with a downwardly depending stud attached to the outer end of the curved section for supporting a rib assembly and a canopy, each of which includes central apertures penetrated by the stud and secured to the stud with a nut, which stretches the flexible canopy into a traditional umbrella shape. The length of the supporting pole is adjustable. The canopy includes a plurality of insertion pockets about its perimeter for receiving and retaining the outer ends of the curved ribs.

10 Claims, 2 Drawing Sheets

PORTABLE SHADE UMBRELLA

BACKGROUND OF THE INVENTION

1. Field of the Invention.

The present invention is related to an apparatus for providing shade from the sun. More particularly, the present invention is directed to a portable umbrella having a relatively large canopy and that can be easily assembled and disassembled for temporary use.

2. Description of Related Art Including Information Disclosed Under 37 C.F.R. Sections 1.97–1.99.

In many outdoor activities, there is no relief from the sun and participants in outdoor summer activities would like to find shade. Common situations where shade from the sun is desired but may not be available include, for example, picnics, family reunions, casual baseball or softball games, tennis, or the like.

An umbrella for this purpose should include a relatively large canopy or cover, be light-weight, sturdy, stationary, be anchored by a firm heavy base, and should be readily portable, which requires that it be easy to assemble and disassemble.

Shade umbrellas are known in the prior art and some are intended to be portable. Some examples are described below.

U.S. Pat. No. 176,145, issued to Chase on Apr. 18, 1876, discloses "Umbrella-Tops for Carriage" comprising a folding umbrella suspended from a pole anchored to a fixture on the side of the umbrella top, which is secured to the mounting pole by a band secured to a pole through the center of the umbrella top.

U.S. Pat. No. 200,945, issue to Smith on Mar. 5, 1878, discloses a "Shade for Children's Carriages" comprising a structure similar to Chase '145 above and further including a star and groove mounting plate that allows the angle of the umbrella top to the vertical to be adjusted, for example, to protect against a lowering sun.

U.S. Pat. No. 2,764,993, issued to Wallace et al. on Oct. 2, 1956, discloses a "Canopy Structure" comprising a square canopy or awning of flexible material that is stretched by poles radiating from a central pole mounting plate in the center of the canopy. The stretching apparatus is located under the canopy.

U.S. Pat. No. 2,767,723, issued to Sears, Jr. on Oct. 23, 1956, discloses a "Tractor Umbrella" comprising a cantilevered umbrella cover with a pivoting top mount that allows the umbrella cover to pivot about a single point of suspension.

U.S. Pat. No. 2,871,868, issued to Faasse et al. on Feb. 3, 1959, discloses an "Adjustable Mount" comprising an adjustable ball mount for suspending the umbrella top from a side mounted support pole.

U.S. Pat. No. 3,120,238, issued to Glatz on Feb. 4, 1964, discloses an "Umbrella" comprising a base that supports a vertical pole. An angled arm is mounted on the top of the vertical pole and an umbrella top is suspended from the top of remote end of the arm by a ball joint that allows the umbrella top to be swiveled about.

U.S. Pat. No. 3,429,320, issued to Edelkind on Feb. 25, 1969, discloses "Umbrella Covers" comprising a frame with a number of elongated ribs mounted onto a central rod having a handle end and a ferrule end, with the ribs lying below the cover.

U.S. Pat. No. 4,347,862, issued to Secon on Sep. 7, 1982, discloses a "Lawn Umbrella" comprising a vertical pole with ribs mounted thereon which engage in pockets in the corners of the fabric umbrella top, which is square with the ribs lying below the fabric top.

U.S. Pat. No. 5,002,081, issued to Stromeyer on Mar. 26, 1991, discloses an "Umbrella With Suspended Canopy" comprising a base having a vertical pole mounted thereon, a cantilevered horizontal arm mounted on the top of the vertical pole, and an umbrella top suspended from the remote end of the arm.

U.S. Pat. No. 5,339,847, issued to Kanter et al. on Aug. 23, 1994, discloses a "Beach Umbrella" comprising a square canopy of flexible material held in position by four ribs located under the canopy, with ends inserted into pockets in the corners of the canopy. The canopy is suspended by a vertical pole of adjustable length that engages one corner of the canopy.

Each of these prior art references discloses some type of umbrella, but all are either not portable or are difficult to assemble and disassemble due to elaborate mechanisms for mounting the canopy or cover onto the supporting frame.

Therefore, a need exists for a stationary, portable shade umbrella that is easy to assemble and to disassemble for transport to and from the selected usage site.

SUMMARY OF THE INVENTION

Accordingly, it is a primary object of the present invention to provide a stationary, portable shade umbrella that is easy to assemble and to disassemble for transport to and from the selected usage site.

It is another object of the present invention to provide a stationary, portable shade umbrella that is aesthetically attractive.

It is another object of the present invention to provide a stationary portable shade umbrella that is relatively inexpensive and simple to manufacture.

The present invention is directed to providing a portable shade umbrella that is light-weight, but sturdy and readily portable because it folds easily without the need for a conventional umbrella folding rib structure. The present invention can be used for shade in any open area where shade is desired, for example, at little league baseball games, holiday picnics, family reunions, and so forth.

The present invention comprises a base having a Y-shaped or U-shaped plan, that is the base includes, feet that are spread apart for stability, and which is weighted or made from heavy dense material, such as concrete; a vertical pole or rod to carry a canopy. The length of the vertical pole may be adjusted by any of a number of well-known techniques, e.g., aligned holes with a holding pin inserted through the desired holes, telescoping pole, and the like. A bottom end of the pole is received in a recess or hole in the base. An arching or curved portion is attached to the top of the vertical section of the pole, again by any of a number of well-known techniques. The arched section allows the canopy to be displaced from the base, which makes the shade created by the portable shade umbrella completely usable.

The canopy is made from a relatively thin, flexible sheeting material, such as polyethylene, canvas, linen, and the like, which may be decorated with any desired colors and patterns to make the canopy attractive. The canopy is circular (any desired shape may be used) and includes a central aperture, heavily reenforced with stitching, and, in one embodiment, with additional material, for receiving a holding mechanism, and includes a plurality of pockets, numbering four in the preferred embodiment, for receiving outer ends of the rib pieces. The pockets are preferably plastic that is permanently fastened to or formed in the canopy.

A pair of arched ribs cross at their centers or middle and the outer ends of the ribs are secured in the pockets located along the circumference of the canopy.

The canopy and rib assembly is fastened to the arched support pole section by a depending threaded rod or stud that is inserted through the aperture in the canopy and through a similar aperture in the middle of each of the rib, pairs, each of which includes a widened central aperture portion that receives the stud. Then a washer is placed onto the rod, and a wingnut is threaded onto the rod and tightened to fasten the canopy and rib assembly onto the supporting poles.

The ribs and fastening mechanism can be made of plastic. The canopy can be made in any desired size or shape, limited in the present application only by the desire to keep the device readily portable and stable in reasonable winds.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out the invention are disclosed in detail herein. The embodiments disclosed herein, however, merely illustrate the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus disclosed herein as embodied in any appropriately specific and detailed structure.

Figure 1:
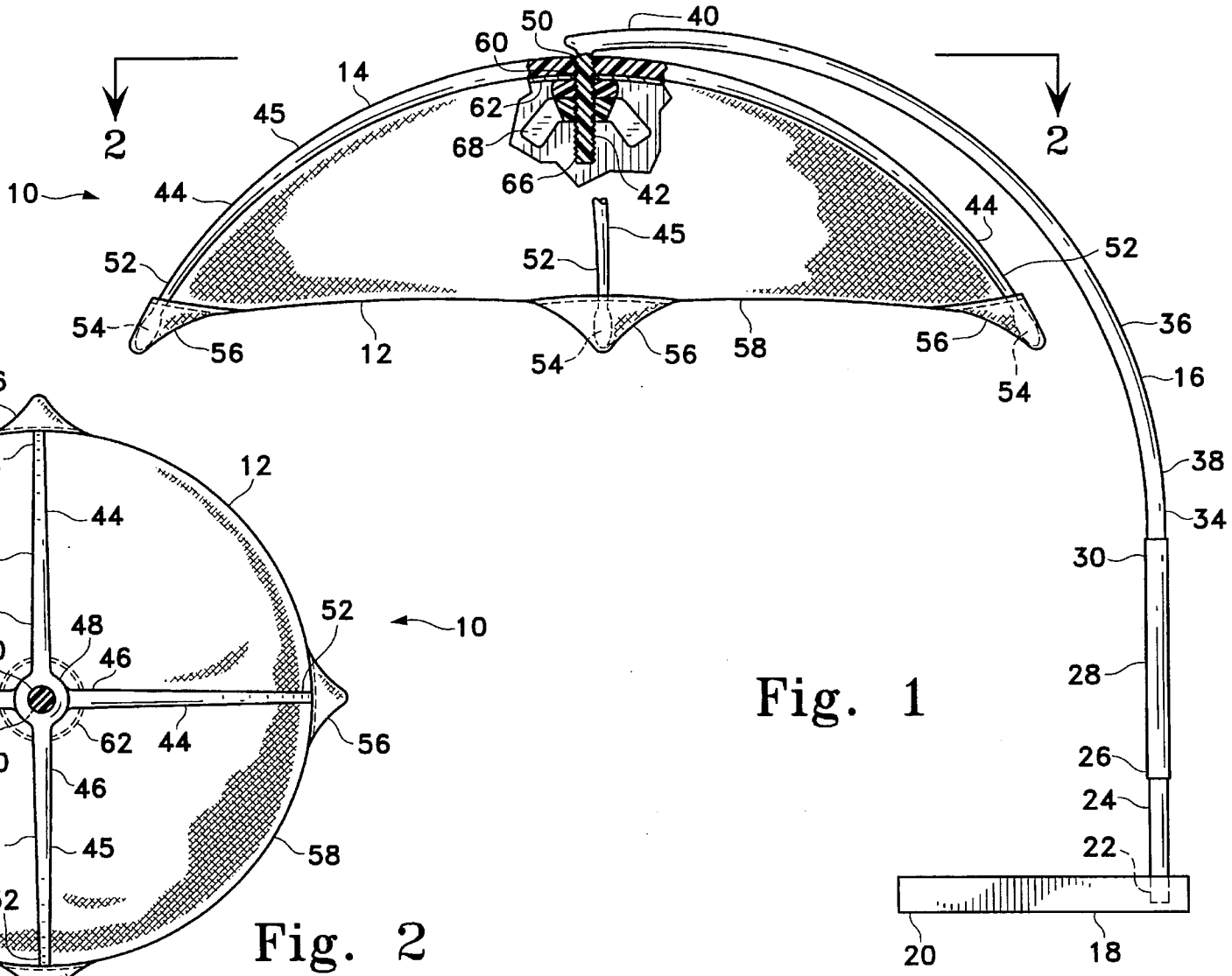
FIG. 1 is side elevation, partially in section of a portable shade umbrella according to the present invention.

Referring now to FIG. 1, there is shown a portable shade umbrella 10 according to the present invention, having a canopy 12 supported by a rib member assembly 14, with the canopy 12 and rib member assembly 14 fastened to a supporting pole 16, which is fixed in a base 18 that is supported by the ground or other surface.

The base 18, in the preferred embodiment illustrated herein, is a substantially planar U-shaped base having leg portions 20 (FIG. 3), which are oriented to project toward a location under the canopy 12. A threaded vertical bore 22 in the bottom or lower portion of the U-shape of the base 18 receives a lower threaded intermediate supporting pole member 24, which is hand-tightened during set up. The base 18 is made from metal or other dense material to prevent the portable shade umbrella 10 from tipping over during normal conditions. Alternatively, the base may be made of concrete and the lower threaded supporting pole member 24 may be permanently fixed therein. Providing a threaded lower supporting pole member 24, however, increases the portability of the portable shade umbrella 10. Naturally, the base may be designed in other shapes, for example circular, rectangular in plan view, and so forth.

The lower threaded supporting pole member 24 is straight and attached to an upper end 26 thereof, which is also threaded, is an intermediate supporting pole member section 28, which is also straight and is adopted to receive the male threads of the lower threaded supporting pole member 24. Also including female threads is an upper end 30 of the intermediate supporting pole member 28, which receive the male threads 32 at the lower end 34 of an upper supporting pole member 36, which includes a straight lower leg portion 38, with the remainder of the upward-projecting portion of the upper supporting pole member 36 being curved in a uniform radius arc such that the canopy 12 does not touch or otherwise contact the supporting pole 16. Removing or omitting the use of the intermediate pole member 28 or the lower supporting pole member 26 lowers the height of the canopy 12, making the height adjustable. Any desired number of intermediate supporting pole members may be readily employed to adjust the height of the canopy 12 as desired. A telescoping supporting pole can also be employed to permit convenient adjustment of the height of the portable shade umbrella 10.

At an upper end 40 of the upper or curved supporting pole member 36 is a downwardly projecting vertical threaded stud 42, which may be integrally formed with the upper supporting pole member section 36 or may be a separate member fixed thereto with a nut or the like. The threaded stud 42 supports the rib members 14 and canopy 12 assembly, as described below.

Figure 2:
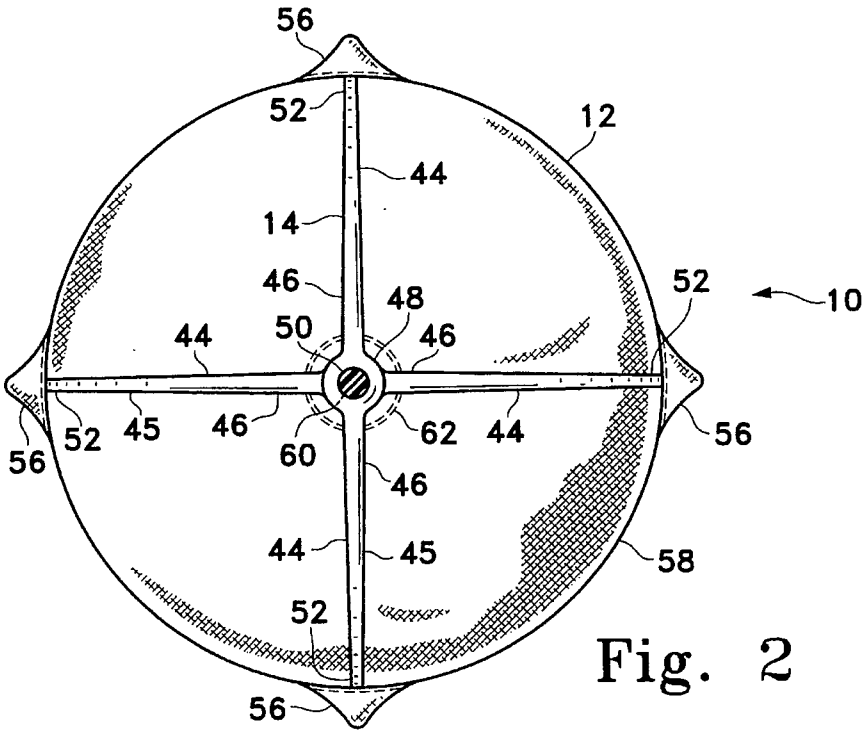
FIG. 2 is a top plan view of the canopy and rib portions of the portable shade umbrella of FIG. 1.

The rib member assembly 14 consists of a pair of unitary ribs connected to form a bow-like structure 45, each having two individual ribs 44 arranged in a straight line in plan view and lying in a single plane. A pair of the bow-like structures 45 is arranged in the shape of a cross that is, defining two perpendicular lines in plan view, as best seen in FIG. 2, with one rib structure 45 lying adjacent to and below the other. Each rib 44 includes an inner end 46, whose width expands to form a circular flange portion 48, having a central aperture 50, where any two ribs 44 connect to form a bow-like structure, or two-rib member 45, which is at the middle of each individual two-rib member 45. Thus, each one-piece two-rib member 45 includes two ribs 44 that are connected at the middle of their span into a one-piece two-rib member 45. Each of the ribs 44 includes an outer end 52, each of which terminates in an enlarged lug portion 54 (See FIG. 3).

In the preferred embodiment, the rib member assembly 14 is a formed from two of the bow-like structures 52 and is made from injection-molded plastic, fiberglass, any of a number of two-part epoxy resins, or the like. Each of the ribs 44 is curved downwardly from the circular flange 48 to its outer end 52. Each rib 44 is identical except for the direction of orientation. In the preferred embodiment, there are four ribs 44, but any number of ribs any desired number greater than three may be employed.

As shown in the preferred embodiment illustrated herein, the canopy 12 is primarily circular but includes four insertion pockets 56 of roughly triangular shape adapted to receive and retain the enlarged lug portions 54 of the ribs 44, which are located on an outer end of each rib 44. That is, the insertion pockets 56 are arranged about a perimeter 58 of the canopy 12 such that they are aligned with the outer ends 52 of the rib member assembly 14 when the rib member assembly 14 is superposed with the canopy 12. In the preferred embodiment illustrated and discussed herein, the canopy 12 is circular in plan view, so its perimeter is a circumference, but canopies may naturally be any desired shape, for example, square, rectangular, pentagonal, and so forth. The canopy 12 further includes a central aperture 60, which aligns with the apertures 50 in the rib member assembly 14. Adjacent to and surrounding the aperture 60 is a stitched reinforcement member 62 that strengthens the canopy 12 about the central aperture 60 therein.

Figure 3:
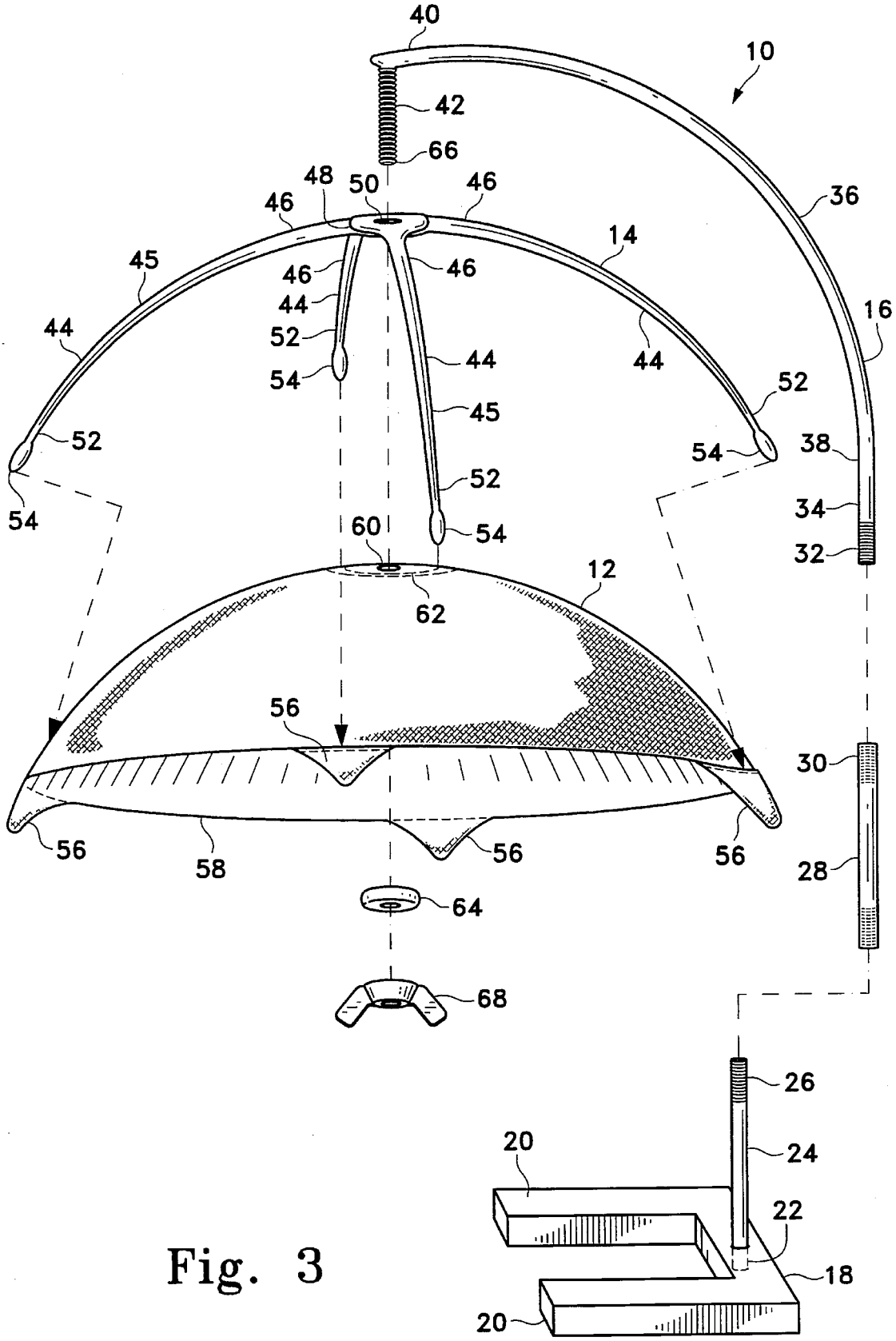
FIG. 3 is an exploded side elevation of the portable shade umbrella of FIG. 1 illustrating the assembly of the present invention.

Referring principally to FIG. 3, the portable shade umbrella 10 is assembled as follows. The base 18 is set down in the desired location. The lower threaded supporting pole member 24 is threadably secured within the base 18. Then the intermediate supporting pole member 28 is threadably secured into the lower threaded supporting pole member 24. Then the upper or curved supporting pole member 36 is threadably inserted into the upper end 30 of the intermediate supporting pole member 28. Now the base 18 and supporting pole 16 are assembled.

The canopy 12, which is made of any desired flexible material such as fabric, plastic, or the like, is unfolded into its open position and one enlarged lug portion 54 on the outer end 52 of each rib 44 is inserted into an aligned insertion pocket 56, until all ribs 44 and insertion pockets 56 have been so joined. The rib member assembly 14 lies above the canopy 12 and these two elements are superposed when this step has been completed. The canopy 12 is not yet stretched into a dome or typical umbrella shape, which is achieved when the now joined canopy and rib assembly are attached to the stud 42.

The now joined rib member assembly 14 and canopy 12 are lifted upwardly and the stud 42 is inserted through the apertures 50 in the rib member assembly 14 and through the central aperture 60 in the canopy 12. A washer 64 is then inserted over a lower end 66 of the stud 42 and a wingnut 68 is threadably attached to the stud 42 and tightened until the canopy 12 assumes the desired dome or standard umbrella configuration. The stud 42 must be long enough to penetrate both the apertures 50 in the rib member assembly 14 and the central aperture 60 in the canopy 12 before the canopy 12 has been stretched into its dome shape.

Placing the rib member assembly 14 above the canopy, rather than beneath it, simplifies and eases assembly of the portable shade umbrella 10 by allowing the translation of rotational force of the wingnut 68 as it travels up the stud 42 to stretch the canopy into its tightened position. In comparison, were the rib member assembly 14 to lie under the canopy 12, the users would have to stretch the canopy manually and center the canopy about the ribs, which can be a difficult and frustrating task. Utilizing the assembly technique of the present invention, however, the rib member assembly 14 and the canopy 12 combination are automatically self-centering and tightening the wingnut 68 readily stretches the canopy 12 into the desired shape, while assuring that the rib member assembly 14 and canopy 12 remain in their desired superposed relationship securely attached to the supporting pole 16. The tension placed on the wingnut 68 in the form of a downward force by the stretching of the canopy 12 ensures that the wingnut 68 will not inadvertently become loose, as this tension serves as a lock washer and eliminates the need for an actual lock washer.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. A portable shade umbrella comprising:

a. a base having a supporting pole threadably attached thereto, said supporting pole having a vertical portion and an upper curved portion terminating in an upper end, wherein said base further comprises a U-shaped base having a threaded pole receiving aperture in a bottom portion of said U-shape of said base;

b. a downwardly depending stud fixed to said upper end of said curved portion of said supporting pole;

c. a rib member assembly comprising a plurality of pairs of ribs, with said rib member assembly connected to an underlying superposed canopy; and d. means for securing said canopy to said ribs members to form a canopy and rib assembly and means for attaching said canopy and rib member assembly to said stud.

2. A portable shade umbrella in accordance with claim 1 further comprising means for adjusting the height of said canopy.

3. A portable shade umbrella in accordance with claim 2 wherein said supporting pole further comprises a plurality of straight intermediate supporting pole members whereby the length of said supporting pole can be readily adjusted by inserting or omitting certain of said straight intermediate supporting pole members and means for connecting said plurality of straight intermediate supporting pole members to one another and means for connecting said curved upper portion of said supporting pole to an upper end of said intermediate supporting pole members.

4. A portable shade umbrella in accordance with claim 1 wherein said rib assembly further comprises at least one pair of two-rib members with said each said two-rib members comprising two one-piece ribs lying in a single plane.

5. A portable shade umbrella in accordance with claim 4 wherein each said rib further comprises a curved rib member forming a downwardly concave curve.

6. A portable shade umbrella in accordance with claim 4 wherein each said two-rib member further comprises a circular flange portion having a central aperture therethrough, with said circular flange portion lying at the middle of each said two-rib member.

7. A portable shade umbrella in accordance with claim 4 wherein an outer end of each said rib further comprises an enlarged lug portion.

8. A portable shade umbrella in accordance with claim 1 wherein said canopy further comprises a plurality of sewn insertion pockets spaced about a perimeter of said canopy for receiving an outer end of each said rib.

9. A portable shade umbrella in accordance with claim 6 wherein said securing means further comprises a central aperture in said canopy aligned with a plurality of central apertures in said rib member assembly, and said canopy central aperture and said rib member central apertures are penetrated by said downwardly depending stud and secured thereto by a nut.

10. A portable shade umbrella comprising:

a. a base having a supporting pole attached thereto, said supporting pole having a vertical portion and an upper curved portion terminating in an upper end;

b. a downwardly depending stud fixed to said upper end of said curved portion of said supporting pole;

c. a rib member assembly comprising a plurality of ribs, wherein said rib assembly further comprises at least one pair of two-rib members with said two-rib members each comprising two single-piece ribs lying in a single plane and each said two-rib member having a circular flange portion having a central aperture therethrough, with said circular flange portion lying at the middle of each said two-rib member, with said rib member assembly connected to an underlying superposed canopy; and d. means for securing said canopy to said ribs members to form a canopy and rib assembly and means for attaching said canopy and rib member assembly to said stud.

* * * * *